US009226577B2

(12) United States Patent
Stepp et al.

(10) Patent No.: US 9,226,577 B2
(45) Date of Patent: Jan. 5, 2016

(54) MODULAR SAFE INTERIOR

(71) Applicant: Prosteel Security Products Inc., Provo, UT (US)

(72) Inventors: Richard E. Stepp, Springville, UT (US); Keith Sanders, Spanish Fork, UT (US)

(73) Assignee: Prosteel Security Products Inc., Provo, UT (US)

( * ) Notice: Subject to any disclaimer, the term of this patent is extended or adjusted under 35 U.S.C. 154(b) by 5 days.

(21) Appl. No.: 13/947,160

(22) Filed: Jul. 22, 2013

(65) Prior Publication Data

US 2014/0027394 A1 Jan. 30, 2014

Related U.S. Application Data

(60) Provisional application No. 61/676,078, filed on Jul. 26, 2012.

(51) Int. Cl.

| | |
|---|---|
| ***A47F 7/14*** | (2006.01) |
| ***A47B 81/00*** | (2006.01) |
| ***E05G 1/00*** | (2006.01) |
| *E05G 1/024* | (2006.01) |
| *A47B 57/42* | (2006.01) |

(52) U.S. Cl.

CPC ..... *A47B 81/005* (2013.01); *E05G 1/00* (2013.01); *A47B 57/42* (2013.01); *E05G 1/024* (2013.01); *Y10T 29/49826* (2015.01)

(58) Field of Classification Search

CPC ..... A47B 81/005; A47B 57/42; E05G 1/00; E05G 1/024; Y10T 29/49826

USPC ..... 211/64, 186, 187, 153; 312/351, 409, 312/257.1; 108/108

See application file for complete search history.

(56) References Cited

U.S. PATENT DOCUMENTS

| | | | | |
|---|---|---|---|---|
| 2,093,277 | A * | 9/1937 | Keighley | 62/329 |
| 2,248,916 | A * | 7/1941 | Opper | 312/351 |
| 2,534,952 | A * | 12/1950 | Comer | 248/243 |
| 2,626,198 | A * | 1/1953 | Vanderveld | 312/108 |
| 2,655,424 | A * | 10/1953 | O'Connor | 312/351 |
| 2,678,793 | A * | 5/1954 | Brochstein | 248/243 |
| 2,783,896 | A * | 3/1957 | Agostini et al. | 211/64 |
| 2,783,961 | A * | 3/1957 | Weber | 248/243 |

(Continued)

OTHER PUBLICATIONS

GE Monogram Built-In All Refrigerator, Model No. ZIRP360NXLH with adjustable shelves, printed at http://appliances.monogram.com/ApplProducts/ZIRP360NXLH, Jul. 11, 2013.

*Primary Examiner* — Joshua J Michener
*Assistant Examiner* — Devin Barnett
(74) *Attorney, Agent, or Firm* — Ostrager Chong Flaherty & Broitman P.C.

(57) ABSTRACT

A modular storage system for an interior compartment of a safe and method for storing guns comprises standardized parts for easy construction and assembly, flexible arrangement and configurations, and use in a wide variety of safes. The interior compartment of the safe is configured to have a back wall and two side walls defining an interior width of the safe. The system comprises a plurality of shelves each having a standardized shelf width. The interior width of the safe is a whole number multiple of the standardized shelf width. A gun storage bay is provided with an exterior bay width equal to the standardized shelf width. The plurality of shelves and the gun storage bay are removably mounted on the back wall.

7 Claims, 11 Drawing Sheets

(56) References Cited

U.S. PATENT DOCUMENTS

| | | | | | |
|---|---|---|---|---|---|
| 2,787,382 | A * | 4/1957 | Williams | 108/157.13 |
| 2,790,559 | A * | 4/1957 | Stephenson et al. | 108/108 |
| 2,956,688 | A * | 10/1960 | Galassi | 108/108 |
| 2,958,422 | A * | 11/1960 | Caloiero et al. | 211/4 |
| 2,971,805 | A * | 2/1961 | Weiss | 312/108 |
| 3,031,069 | A * | 4/1962 | Hirsch | 206/317 |
| 3,067,882 | A * | 12/1962 | Ribbens et al. | 108/102 |
| 3,101,681 | A * | 8/1963 | Streater | 108/28 |
| 3,168,365 | A * | 2/1965 | Evans | 312/351 |
| 3,351,403 | A * | 11/1967 | Magnuson | 312/245 |
| 3,358,847 | A * | 12/1967 | Magnuson | 211/189 |
| 3,626,870 | A * | 12/1971 | Schild | 108/108 |
| 3,807,320 | A * | 4/1974 | Textoris | 108/106 |
| 3,993,002 | A * | 11/1976 | Stroh | 108/108 |
| 4,018,340 | A * | 4/1977 | Gold | 211/44 |
| 4,108,085 | A * | 8/1978 | Shepherd et al. | 108/108 |
| 4,113,107 | A * | 9/1978 | Jaeger | 211/4 |
| 4,344,660 | A * | 8/1982 | Molnar et al. | 312/249.13 |
| 4,461,385 | A * | 7/1984 | Clouser | 211/4 |
| 4,624,376 | A * | 11/1986 | Bertram | 211/187 |
| 4,928,833 | A * | 5/1990 | Huizenga | 211/187 |
| 5,072,839 | A * | 12/1991 | Arnone | 211/187 |
| 5,163,567 | A * | 11/1992 | Betts, Sr. | 211/75 |
| D343,970 | S * | 2/1994 | Campbell | D6/437 |
| 5,405,114 | A * | 4/1995 | Dias | 248/250 |
| 5,472,103 | A * | 12/1995 | Merl | 211/187 |
| 5,477,971 | A * | 12/1995 | Howard | 211/187 |
| 5,592,886 | A | 1/1997 | Williams et al. | |
| 5,611,442 | A * | 3/1997 | Howard | 211/187 |
| 5,738,019 | A * | 4/1998 | Parker | 108/108 |
| 5,769,520 | A * | 6/1998 | Jun et al. | 312/408 |
| 5,772,295 | A * | 6/1998 | Sundmark | 312/246 |
| 6,042,207 | A * | 3/2000 | Crosby et al. | 312/351 |
| 6,047,870 | A * | 4/2000 | Morford | 224/551 |
| 6,179,136 | B1 * | 1/2001 | Kluge et al. | 211/90.01 |
| 6,513,889 | B1 * | 2/2003 | Park | 312/206 |
| 6,517,174 | B2 * | 2/2003 | Sevier | 312/257.1 |
| 6,868,975 | B2 * | 3/2005 | Sells et al. | 211/4 |
| 6,918,499 | B2 * | 7/2005 | De Land et al. | 211/187 |
| 6,951,289 | B2 * | 10/2005 | Scott, Jr. | 211/64 |
| 6,953,176 | B2 | 10/2005 | Remmers | |
| D548,487 | S * | 8/2007 | Osiecki et al. | D6/467 |
| 7,261,214 | B2 * | 8/2007 | Wagner et al. | 211/90.02 |
| 7,296,697 | B2 | 11/2007 | Costa et al. | |
| 7,497,344 | B2 * | 3/2009 | Chen | 211/187 |
| 7,497,533 | B2 * | 3/2009 | Remmers | 312/404 |
| 7,523,903 | B1 * | 4/2009 | Rindoks et al. | 248/250 |
| 7,673,762 | B2 * | 3/2010 | Humberto | 211/186 |
| 7,770,740 | B2 * | 8/2010 | Punzel et al. | 211/64 |
| 7,780,018 | B1 * | 8/2010 | Sauder et al. | 211/134 |
| 7,874,628 | B2 * | 1/2011 | Maier-Hunke | 312/257.1 |
| 7,886,919 | B2 * | 2/2011 | Battaglia et al. | 211/189 |
| 8,038,021 | B2 * | 10/2011 | Chen | 211/192 |
| 8,061,539 | B2 * | 11/2011 | Punzel et al. | 211/103 |
| 8,172,347 | B2 * | 5/2012 | Lim et al. | 312/408 |
| D662,341 | S | 6/2012 | Sanders | |
| 8,376,152 | B2 * | 2/2013 | Holmes, Jr. | 211/64 |
| 8,485,613 | B1 * | 7/2013 | Steffen et al. | 312/107 |
| 8,596,205 | B2 * | 12/2013 | Driver et al. | 108/27 |
| 8,651,600 | B2 * | 2/2014 | Cheong et al. | 312/408 |
| 8,672,150 | B2 * | 3/2014 | Chen et al. | 211/187 |
| 8,678,206 | B2 * | 3/2014 | Kubiniec | 211/64 |
| 2003/0168951 | A1 * | 9/2003 | Holbrook et al. | 312/245 |
| 2004/0055514 | A1 * | 3/2004 | De Land et al. | 108/108 |
| 2004/0130250 | A1 * | 7/2004 | Cleveland et al. | 312/409 |
| 2004/0140280 | A1 * | 7/2004 | Cleveland et al. | 211/64 |
| 2005/0115912 | A1 * | 6/2005 | Szuminski et al. | 211/64 |
| 2005/0133473 | A1 * | 6/2005 | Lesperance | 211/64 |
| 2005/0145147 | A1 * | 7/2005 | Costa et al. | 108/108 |
| 2005/0150436 | A1 * | 7/2005 | Marchetta et al. | 108/108 |
| 2005/0167378 | A1 * | 8/2005 | Scott, Jr. | 211/64 |
| 2005/0218767 | A1 * | 10/2005 | Jeong et al. | 312/408 |
| 2006/0255699 | A1 * | 11/2006 | Punzel et al. | 312/217 |
| 2006/0283820 | A1 * | 12/2006 | Peters et al. | 211/64 |
| 2007/0000851 | A1 * | 1/2007 | Matzick | 211/64 |
| 2007/0024165 | A1 * | 2/2007 | Moulton | 312/291 |
| 2007/0046160 | A1 * | 3/2007 | Egan | 312/408 |
| 2007/0170129 | A1 * | 7/2007 | Punzel et al. | 211/64 |
| 2007/0188058 | A1 * | 8/2007 | Punzel et al. | 312/221 |
| 2007/0221103 | A1 * | 9/2007 | Trausch | 108/108 |
| 2008/0296245 | A1 * | 12/2008 | Punzel et al. | 211/153 |
| 2009/0014400 | A1 * | 1/2009 | Nawrocki | 211/90.03 |
| 2009/0079308 | A1 * | 3/2009 | Punzel et al. | 312/306 |
| 2009/0230826 | A1 * | 9/2009 | Myers | 312/204 |
| 2010/0102689 | A1 * | 4/2010 | Chambers et al. | 312/257.1 |
| 2010/0116762 | A1 * | 5/2010 | Piersant et al. | 211/90.01 |
| 2010/0122960 | A1 * | 5/2010 | Bliss | 211/64 |
| 2011/0025181 | A1 * | 2/2011 | Vinke et al. | 312/257.1 |
| 2011/0168649 | A1 * | 7/2011 | Stolz | 211/4 |
| 2012/0176013 | A1 * | 7/2012 | Woods | 312/270.3 |
| 2012/0228243 | A1 * | 9/2012 | Crigger et al. | 211/7 |
| 2012/0267282 | A1 * | 10/2012 | Holmes, Jr. | 206/526 |
| 2013/0002116 | A1 * | 1/2013 | Lodge et al. | 312/351.1 |
| 2014/0083959 | A1 * | 3/2014 | Kalafut | 211/13.1 |
| 2014/0111073 | A1 * | 4/2014 | Kunis | 312/257.1 |

* cited by examiner

MODULAR SAFE INTERIOR

RELATED APPLICATIONS

This application claims priority to and incorporates by reference U.S. Provisional Patent Application No. 61/676,078, filed Jul. 26, 2012.

TECHNICAL FIELD

This disclosure relates generally to the field of security safes and vaults and, more particularly, to improvements in safe and vault interior shelving, storage and organization.

BACKGROUND

Security safes and vaults for home and commercial use, including for the storage of guns, ammunition, important papers and other valuables or items, are well known and are collectively referred to herein as a "safe" or "safes". The term "guns" as used herein includes but is not limited to handguns, pistols, rifles, shotguns and other types of firearms. Typical safes are constructed to form a rectangular box having a hollow interior space used for storage and protection of guns, valuables and other items. Protection may be from unwanted intruders or from fire or water damage. A security door is hingedly attached to either a top or side panel of the safe's frame to provide access to the interior space and to protect the safe from unwanted intrusion. Security doors may be constructed with enhanced security features, such as multiple locking bolts or pins that simultaneously project from or retract into one or more sides of the door. The locking bolts or pins extend either behind a door frame or are inserted into apertures within the door frame to secure the door in a locked position. Safes may also include fireproof layers or additional protective layers in the structure of the rectangular box, which typically reduce the dimensions of the interior space and the available storage area therein.

Typical gun safes employ shelving systems with shelves supported by both side walls of the safe and a vertical board that divides the interior space into two distinct areas. The vertical board is typically placed in a position to provide a first area that is about one-third of the width of the interior space and a second area that is about two-thirds of the width of the interior space. The safe may be configured to have, for example, shelving across the entire width of the interior space above the vertical board and/or shelving on either side of vertical board. The interior space may include an open bay for storing rifles (or other types of long guns) on one or both sides of the vertical board, and the opposite side may include shelving. However, long items cannot be stored horizontally in a safe with a vertical interior dividing board, and the vertical interior dividing board limits shelving configuration options and occupies valuable storage space. It would therefore be advantageous to provide a more flexible storage system with no vertical interior dividing board to open up the shelf space for wider or longer objects and optimize the cubic storage area within the safe.

Most manufacturers design safes from the outside in, starting with a steel casing and adding insulation to form an interior compartment, and then making a shelving system to fit inside the safe's interior compartment. Shelves in safes are typically formed from wood boards covered with carpet or another textile material, and cut to the width and depth of a safe's interior compartment. In other words, the size of currently available shelving is determined by and limited by the size of the safe's interior compartment. Safe manufacturers offer many different sizes of safes, and each safe size requires a unique size shelf designed to fit into the safe. It is therefore difficult and expensive for safe manufacturers to build, stock and supply customers and dealers with a unique size shelf for every safe size that they sell. That would require hundreds of unique shelf widths and depths. The current state of safe manufacturing also makes it difficult for safe manufacturers and dealers to provide consumers with a variety of options for setting up a safe's interior compartment.

Because of the expanding uses and demand for commercial and personal safes, there is a need to address the weaknesses of traditional safe interiors and provide safes with unparalleled versatility, to improve facilities to enable flexible and inexpensive storage systems for safes, and enable widespread manufacture and stocking of such parts.

SUMMARY

The foregoing purposes, as well as others that will be apparent, are achieved generally by providing a modular storage system for an interior compartment of a safe composed of standardized parts for easy construction and assembly, flexible arrangement and configurations, and use in a wide variety of safes. The interior compartment of the safe is configured to have a back wall and two side walls defining an interior width of the safe. The system comprises a plurality of shelves each having a standardized shelf width. The interior width of the safe is a whole number multiple of the standardized shelf width. A gun storage bay is provided with an exterior bay width equal to the standardized shelf width. The plurality of shelves and the gun storage bay are removably mounted on the back wall to permit flexible arrangements of the shelves and gun storage bays in both horizontal and vertical directions. An exemplary arrangement may include positioning the gun storage bay above one of the shelves to form a gun rack, where the shelf provides a bottom support for the gun and the gun storage bay provides a top support for the gun. The height of the gun storage bay and the shelves within the safe is separately adjustable to permit storage of guns of varying lengths and positioning of the gun rack at adjustable heights within the safe.

Another aspect of the subject matter disclosed is a method for storing guns in an interior compartment of a safe, the interior compartment having a back wall and two side walls defining an interior width of the safe. The method comprises the steps of providing a plurality of shelves each having a standardized shelf width, the interior width of the safe being a whole number multiple of the standardized shelf width, providing a gun storage bay having an exterior bay width equal to the standardized shelf width, and removably mounting the plurality of shelves and the gun storage bay on the back wall to permit flexible horizontal and vertical arrangements of the shelves and the gun storage bay. The method may further comprise positioning the gun storage bay above one of the shelves to form a gun rack wherein the one of the shelves supports a bottom end of a gun and the gun storage bay supports a top end of the gun, and adjusting the height of the gun storage bay and the height of the one of the shelves to permit storage of guns of varying lengths and positioning of the gun rack at adjustable heights within the safe.

The subject matter disclosed herein is also directed to a method for manufacturing a safe with a modular storage system, the method comprising the steps of providing a plurality of shelves each having a standardized shelf width and designing an interior compartment of the safe with a back wall and two side walls defining an interior width of the safe, the interior width of the safe being a whole number multiple of the standardized shelf width.

The systems and methods disclosed herein provide a cost-efficient, modular storage system for a safe that may be flexibly configured and arranged with shelves, gun storage bays and other storage elements, and adjustably-sized gun racks that may be positioned at varying heights within the safe. Other objects, features and advantages of the present disclosure will be apparent when the detailed description of preferred embodiments is considered in conjunction with the following drawings.

BRIEF DESCRIPTION OF THE DRAWINGS

Various embodiments will be hereinafter described with reference to drawings for the purpose of illustrating the foregoing and other aspects of the disclosure.

DETAILED DESCRIPTION

The following detailed disclosure describes a modular storage system and methods for storing guns and other valuables in an interior compartment of a safe. The disclosure also describes a method for manufacturing a safe having a modular storage system.

Figure 1:
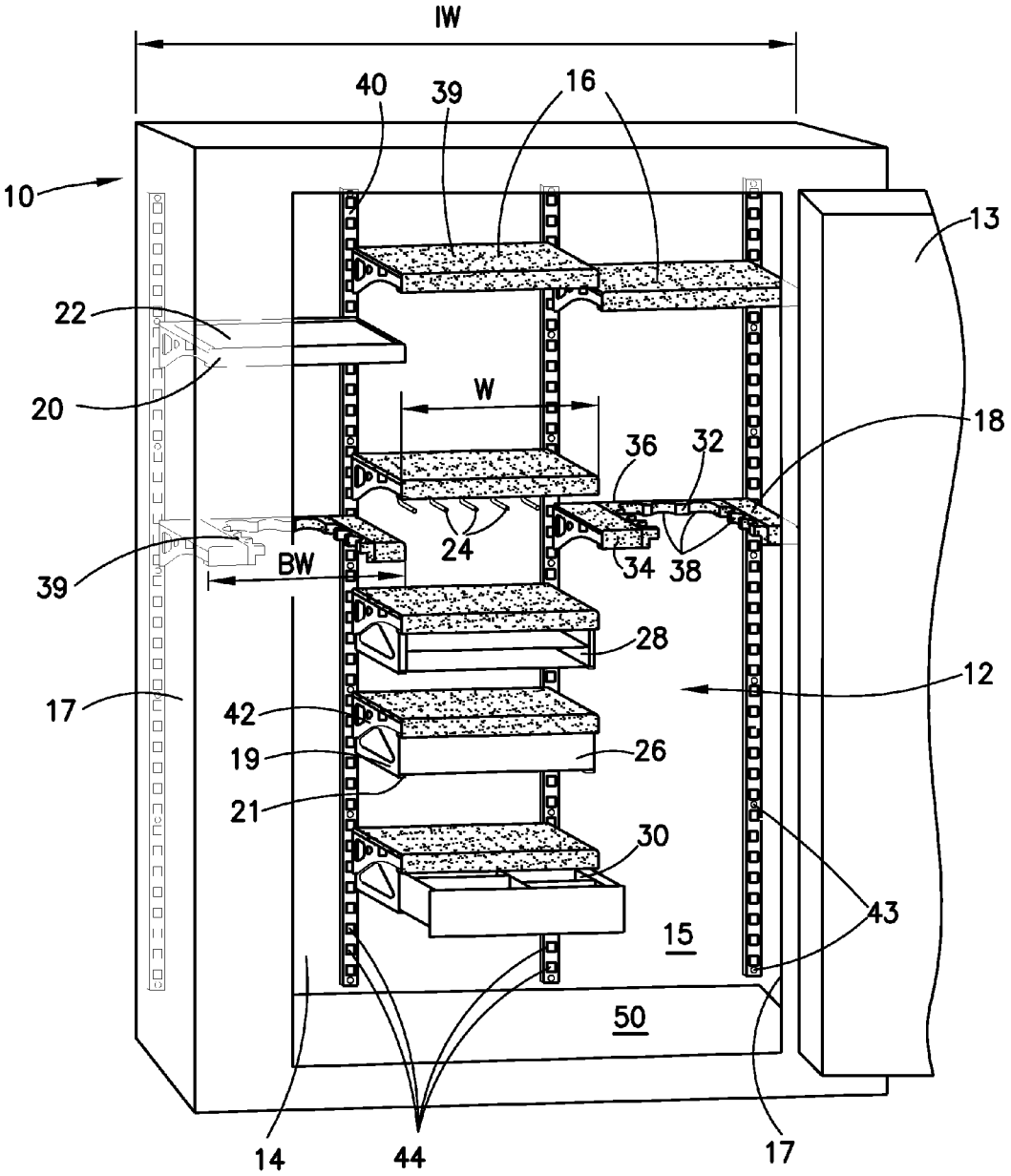
FIG. 1 is a diagram showing a perspective view of a safe having a modular storage system.

FIG. 1 shows a safe 10 with a modular storage system 12 in one exemplary configuration and arrangement installed in an interior compartment 14 of the safe 10. FIGS. 2A-2D show the safe 10 with a modular storage system 12 in other exemplary configurations and arrangements. The interior compartment 14 of the safe 10 has a back wall 15 and two side walls 17 that define an interior width IW of the safe 10. A safe door 13 is shown in FIG. 1 but has been removed from FIGS. 2A-2D.

The modular storage systems 12 shown in FIGS. 1 and 2A-2D employ shelves 16, a gun storage bay 18, and a variety of other storage elements including shelves 20 having a drop-in glass or metal insert 22, a handgun rack 24 where the hole in a handgun barrel may be slid onto the handgun rack 24, a pullout drawer 26, a document tray 28, and a jewelry organizer tray 30. The handgun rack 24, pullout drawer 26, document tray 28, and jewelry organizer tray 30 may be mounted below the shelves 16, e.g., by affixing them to the bottom or side surfaces of the shelves 16, or they may be manufactured as integral parts of the shelves 16. Alternatively, the shelves 16 may be provided with holders 19 mounted to both sides of the shelves 16 or to brackets 42 mounted to the shelves. Mounting of any of the parts together may be done by screws, rivets or other types of mounting means for assembling two metal or plastic parts together. The holders 19 extend below the shelves 16, and have a lower lip 21 that bends inward to form a supporting surface for a pullout drawer 26, document tray 28, or jewelry organizer tray 30. The holders 19 and lower lip 21 provide a track for the pullout drawer 26, document tray 28, and jewelry organizer tray 30 to slide into. This permits all of the storage elements to be readily interchangeable and reconfigured to slide into any shelf. The pullout drawer 26, document tray 28 and jewelry organizer tray 30 can also be stacked one on top of each other underneath the same shelf 16. For example, two or more pullout drawers 26 may be chained or otherwise linked together underneath one shelf. This may also apply to one pullout drawer 26 and one document tray 28, or a document tray 28 and a jewelry organizer tray 30 or any other combination.

The shelves 16 and other storage elements may be made from wood and covered with carpet. Brackets 42 may be mounted to the sides of the wooden shelves. Alternatively, the shelves 16 and other storage elements are metal and have a co-molded protective surface covering 39, such as a rubberized plastic to protect items stored on the shelf. The protective surface covering 39 covers the entire top surface of a shelf 16 and preferably wraps around the edges of the shelf 16. The metal may be 1008 hot rolled steel with a thermoplastic elastomer (TPE) covering, or a stainless steel may be used. Metal shelves may be powder coated with textured black paint to prevent the metal from rusting. The protective surface coating 39 is desirably thin, and has a thickness in the range of about 0.05" to 0.1". The thickness need not be uniform throughout the entire protective surface covering 39; it could have areas where the thickness is about 0.05" and other areas that are thicker.

Figure 3:
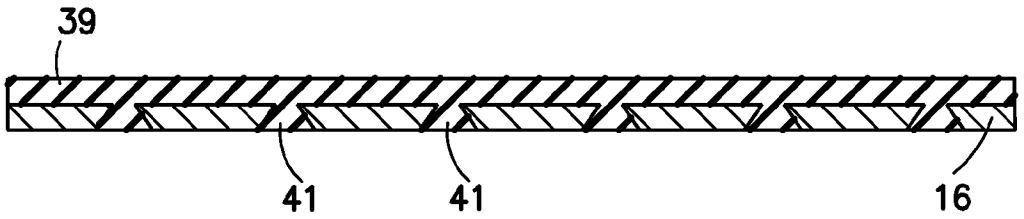
FIG. 3 is a diagram showing a cross-section view of a shelf having a protective coating.

There is some adhesion between the protective surface coating 39 and the powder coating on the shelves 16. Mechanical means may be added to enhance the adhesion over the large surface area of the shelf. FIG. 3, for example, shows a cross-sectional view of an exemplary shelf 16 with a protective surface covering 39. Holes 41 are provided with a reverse counter-sink where the opening at the top surface of the shelf is smaller than the opening in the bottom surface of the shelf, such that the protective coating 39 can be inserted through the holes 41 from the top surface. The reverse counter-sunk holes 41 permit the protective coating to expand or flare out at the bottom surface of the shelf, creating an anchor to keep the protective coating 39 in place on the shelf 16. The counter-sunk holes 41 may be provided by first drilling a hole in the metal with a standard drill bit and then using a counter-sink drill bit on the underside of the shelf 16 to form the reverse-counter holes 41. The holes 41 are spaced apart by approximately an inch and positioned along the edges and corners of the shelf 16 where the protective surface coating 39 bends and is more likely to peel up, but may also be positioned throughout the surface area of the shelf 16, with the concentration of holes in the middle being less than the concentration of holes along the edges and corners.

The gun storage bay 18 is manufactured similar to the shelves 16, but includes a U-shaped cut-out portion 32 extending from a front edge 34 of the gun storage bay 18 to a back edge 36 of the gun storage bay 18. The cut-out portion 32 provides a place for the barrel of a rifle or other type of gun to rest, and may include crescent shaped indents 38 in the cut-out portion 32 to maintain the barrel in a particular position in the cut-out portion 32. The cut-out portion 32 of the gun storage bay 18 may include shaped rubber pads positioned in the crescent shaped indents 38 to provide a soft surface that will not scratch, dent or otherwise mar the barrel, or the entire surface of the gun storage bay 18 may be co-molded with a rubberized protective coating 39 similar to the covering on the shelf described above.

The disclosed shelving system and method also provides an easy way to accommodate new storage solutions to expand the usability of the safe. A rack for archery equipment, fishing supplies, or other valuable outdoor gear could be designed and used in the modular storage system 12 in the same manner described below.

Each of the shelves 16 in the modular storage system 12 has a standardized shelf width W. The gun storage bay 18 has an exterior bay width BW equal to the standardized shelf width W. All of the other storage elements for use with the modular storage system 12 are also manufactured to have a width equal to the standardized shelf width W to provide manufacturing and production efficiencies, and versatility in the configuration and arrangement of the storage elements in the safe 10. The interior width IW of the interior compartment 14 of the safe 10 is designed to be a whole number multiple (e.g., 1, 2, 3 or 4) of the standardized shelf width W such that two or more of the shelves 16 may, if desired, be arranged adjacent one another at the same height to form a shelf that extends the entire interior width W of the interior compartment 15 between the side walls 17, as shown for example, in FIG. 2A.

In the modular storage system 12, a plurality of shelves 16, the gun storage bay 18 and other storage elements are removably mounted on the back wall 15 of the interior compartment 14 of the safe 10 to permit flexible horizontal and vertical arrangements of the shelves 16, gun storage bay 18 and other storage elements. This together with the standardized shelf width W permits quick and easy modification of the configuration, arrangement and storage ability of the safe interior 14.

The plurality of shelves 16, the gun storage bay 18 and other storage elements are removably mounted on the back wall 15 via vertically mounted, slotted tracks 40 and cantilever-type brackets 42. The shelves 16, gun storage bay 18 and other storage elements may be manufactured to include cantilever-type brackets 42 as an integral part of the shelves 16, the gun storage bay 18 and other storage elements. Or, the cantilever-type brackets 42 may be separate parts that are either mounted to the shelves 16, the gun storage bay 18 and other storage elements or are separate parts that simply provide a support for the shelves 16, the gun storage bay 18 and other storage elements to rest upon. The tracks 40 can be manufactured by extrusion, bending, roll forming or other known methods for manufacturing metal parts.

Figure 4:
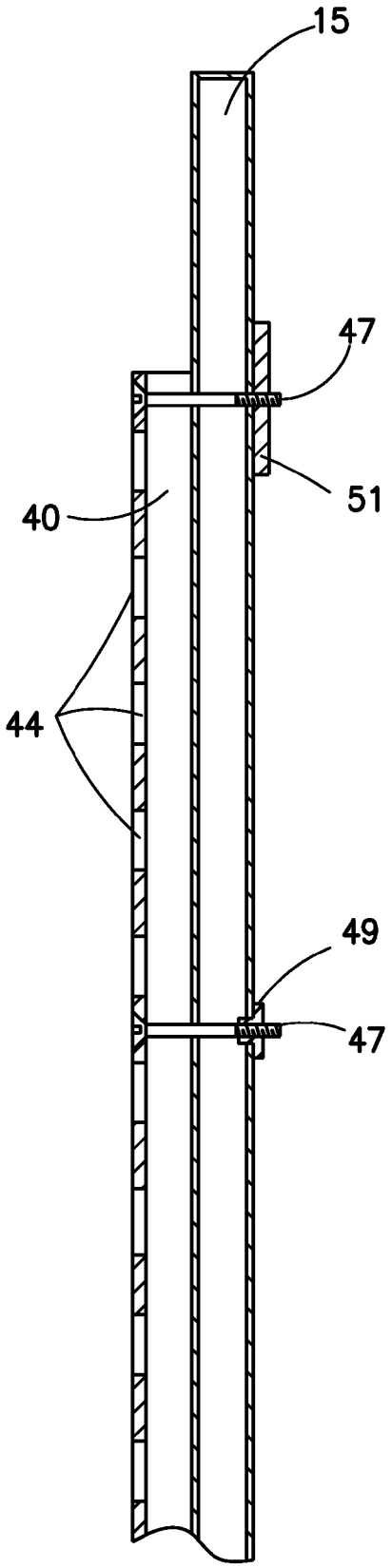
FIG. 4 is a diagram showing a cross-section view of a vertical track mounted on a back wall of an interior compartment of a safe.

The tracks 40 are installed vertically on the back wall 15 of the safe interior 14, and may be mounted to the back wall 15 with screws or other types of bolts through mounting holes 43 in the tracks 40. For example, FIG. 4 shows a cross-section view of a track 40 mounted on a back wall 15 with machine screws 47. The back wall 15 of the interior compartment 14 is typically made of drywall or wallboard, such as SHEETROCK®, or wood panels, and may or may not be covered with carpet. The machine screws should be installed near the top and bottom of the tracks 40 and preferably at least one between the top and bottom. Most of the machine screws 47 are secured to the back wall 15 with a T-nut type bolt 49, which has a threaded barrel in the center and wide rim on the back side with pointed flanges that grip the back wall 15 when the machine screw is inserted into the center barrel and provide a load bearing surface. To provide additional load bearing properties, preferably at the top of the tracks 40, a flat metal slug 51 with a large surface area and having a threaded hole is positioned on the back side of the back wall 15, and a machine screw 47 is placed through the mounting hole 43 in the track 40, through the back wall 15 and into the threaded hole in the slug 51. This provides a strong load bearing anchor for the shelves 16 and other storage elements, up to about 150 pounds for each shelf 16 or other storage element.

Figure 5:
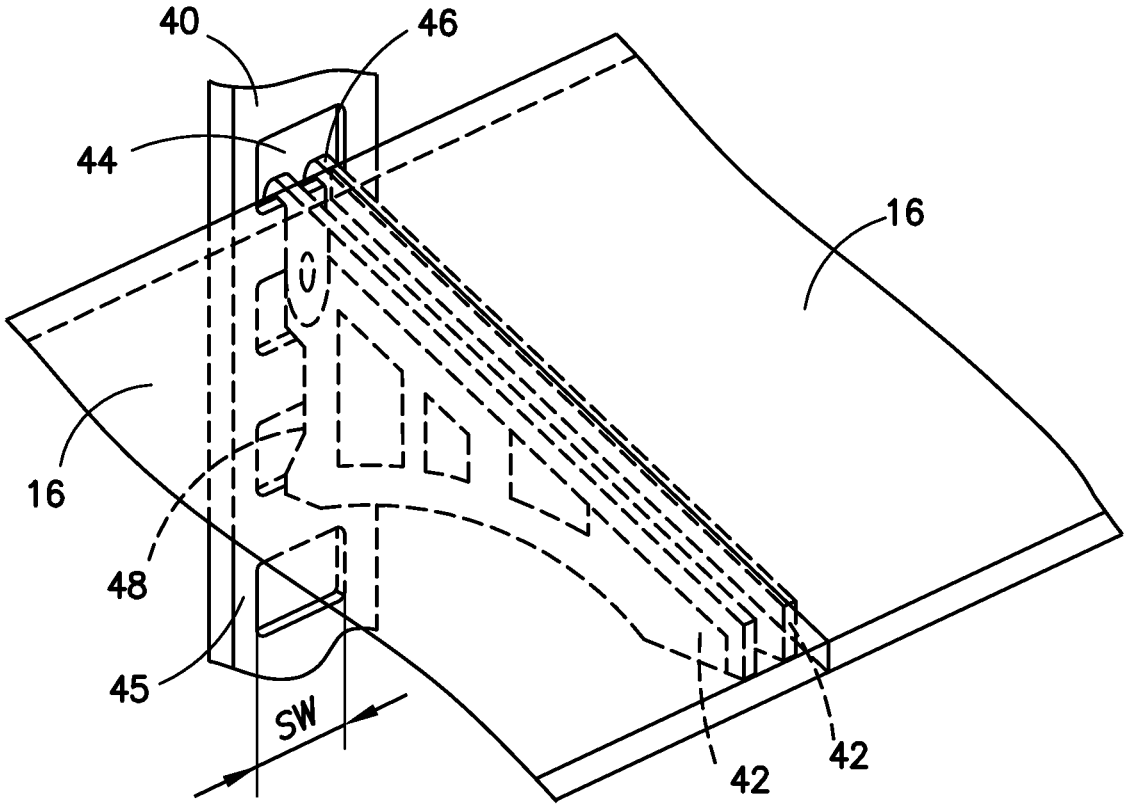
FIG. 5 is a diagram showing a perspective view of two brackets removably mounted to a vertical track for supporting two adjacent shelves at the same height.

The tracks 40 have a plurality of apertures or slots 44 through a front surface 45 of the tracks 40 that extend the length of the tracks 40 and permit the cantilever-type brackets 42 to be removably attached at varying heights onto the tracks. Referring to FIG. 5, the cantilever-type brackets 42 are removably attached to the tracks 40 with a simple bent flange 46 that fits into the slots 44 in the front surface 45 of tracks 40. The combination of the flange 46 in the slots 44 and the back edge 48 of the brackets 42 against the front surface 45 of the tracks 40 provides sufficient support for the shelves 16, the gun storage bay 18 and other storage elements. To remove a bracket 42 from the track 40, the bracket is tipped slightly upward and lifted slightly upward to disengage the flange 46 on the bracket 42 from the slots 44 in the track 40. The slots 44 in the tracks 40 have a slot width SW large enough to accept and secure flanges 46 of two cantilever brackets 42, such that two or more shelves 16 may be positioned adjacent each other at the same height as shown, for example, in FIG. 2A. The slot width SW may be in the range of about 0.4" to 0.7 inches, and is preferably about 0.6". The brackets 42 are made from metal of the types described above for the shelves, and have a thickness in the range of about 0.06" to 0.135", and preferably about 0.075".

The examples shown in FIGS. 1 and 2A-2D show safes 10 that utilize four tracks 40. The number of tracks 40 used is dependent on how many columns of shelves 16, gun storage bays 18 and other storage elements are desired. Four tracks 40 as shown provide for three columns of storage elements. Two tracks 40 may be used to provide one column of storage elements, or three tracks 40 may be used to provide two columns of storage elements. Similarly, five tracks 40 may be used to provide four columns of storage elements.

The tracks 40 are spaced equidistant from each other (for example, 12.5" center to center) along the back wall 15 of the interior compartment 14, such that the center to center distance between adjacent tracks 40 is substantially equal to the standardized shelf width W. The term substantially equal in this application means equal to or slightly (no more than 0.2 inch) greater than. This permits shelves 16, gun storage bays 18 and other storage elements having the standardized width W to be installed between any two adjacent tracks 40. At least two of the tracks 40 are positioned at the corners where the back 15 and side walls 17 intersect.

The modular storage system described above provides the ability to readily arrange and reconfigure the shelves 16, gun storage bays 18 and other storage elements within the safe 10. FIG. 1 shows an example of a modular storage system 12 with three storage columns that utilizes many different types of storage elements for storing guns, papers and other valuables. In this example, a long rifle may be stored in the left and right columns with the butt of the rifle resting on the floor 50 of the interior compartment 14, and the barrel of the rifle resting in the gun storage bay 18. Thus, a gun rack is formed by the floor 50 and the gun storage bay 18.

Figure 2A:
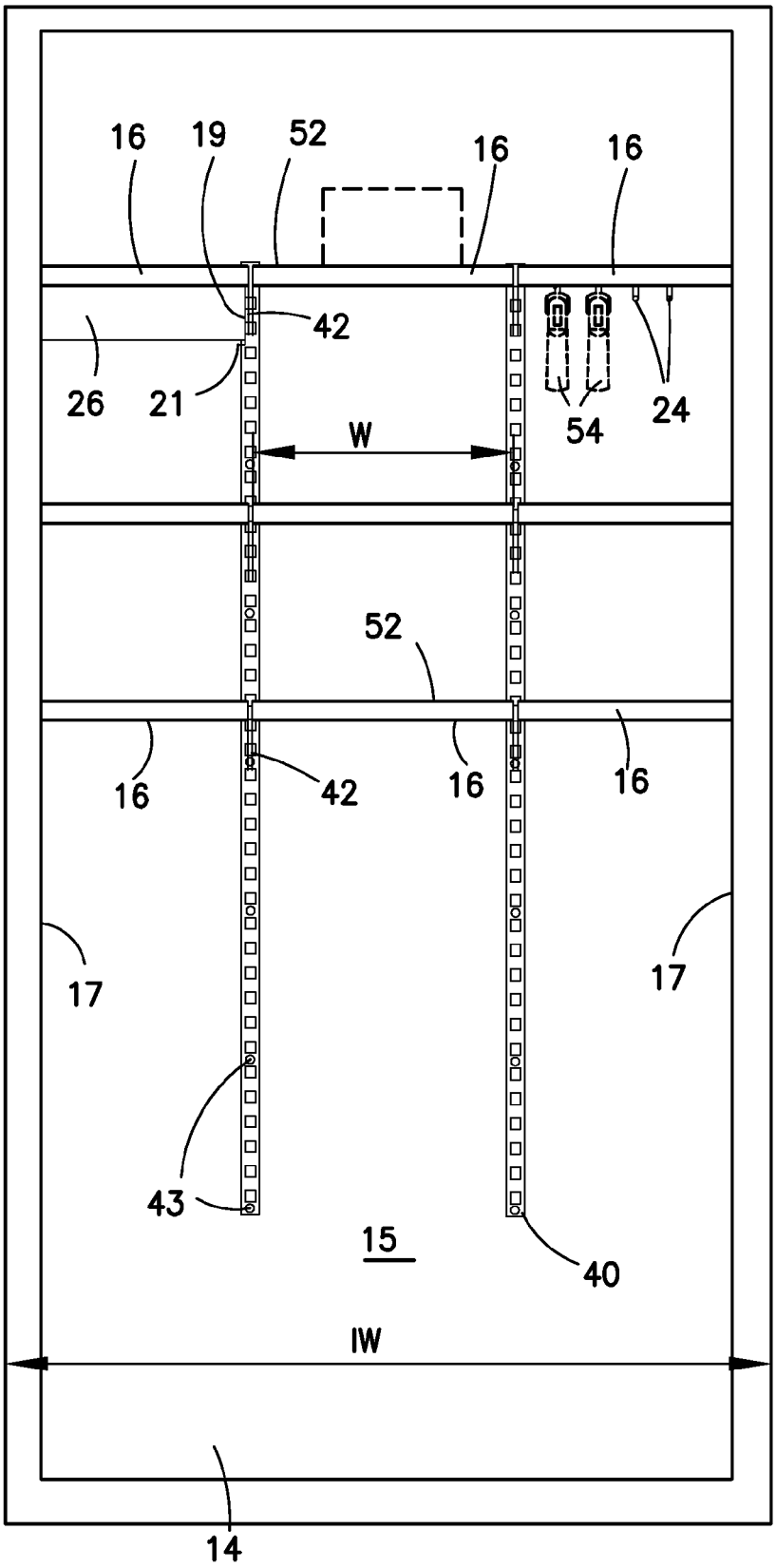
FIGS. 2A-2D are diagrams showing front plan views of a safe having a modular storage system in varying configurations and arrangements.
Figure 2B:
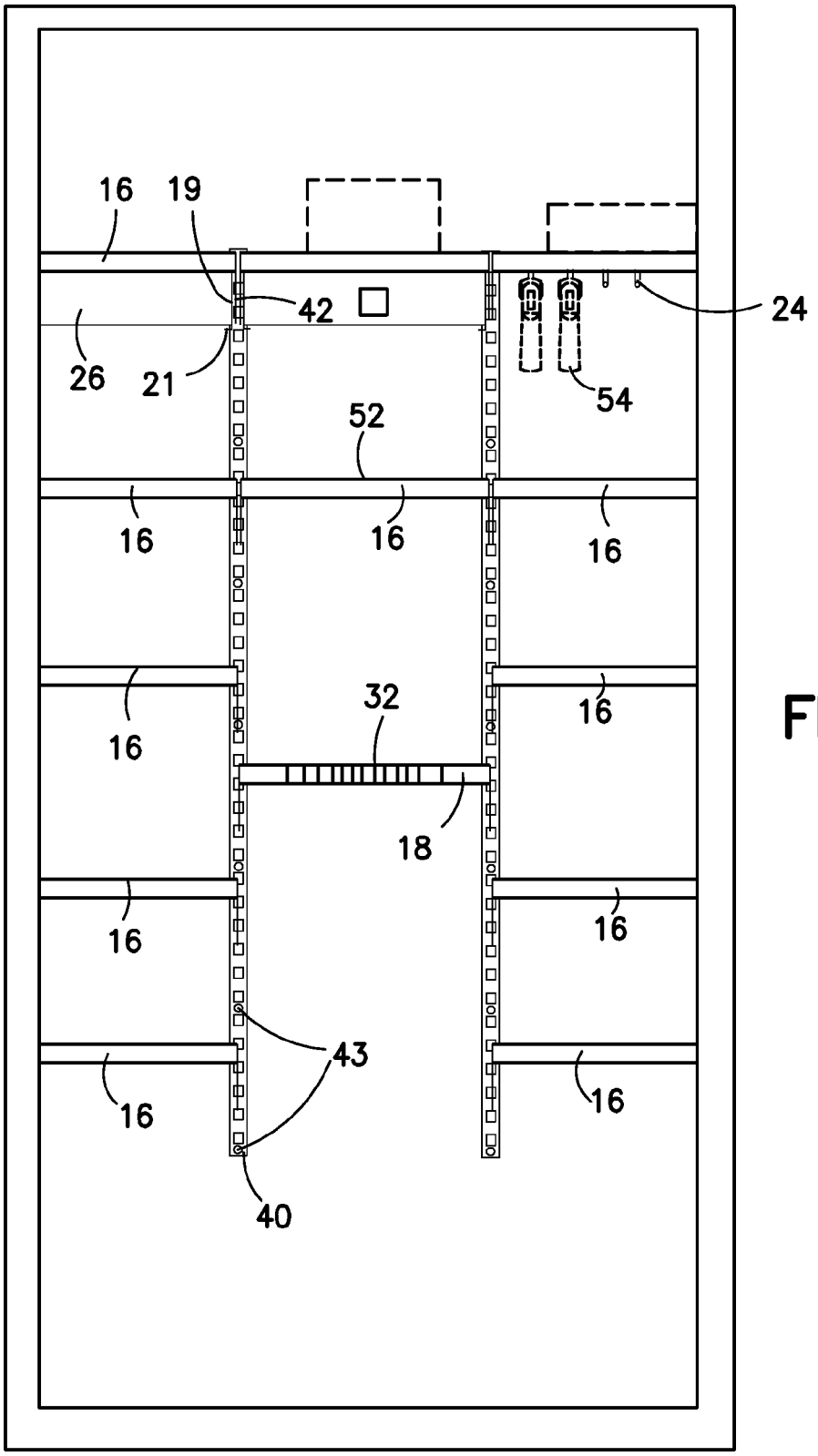

The examples shown in FIGS. 2A-2D show the versatility of a modular storage system 12 having three columns of storage. In FIG. 2A, three shelves 16 are positioned adjacent each other at the same height to provide a long shelf surface 52 extending the entire interior width IW. In the uppermost arrangement of storage elements, again three shelves 16 are positioned adjacent each other at the same height to provide a long shelf surface 52, but the shelves are also provided with a pullout drawer 26 and a handgun rack 24 with a handgun 54 hanging therefrom. FIG. 2B shows a different arrangement of the modular storage system 12 including shelves 16, a gun storage bay 18, a pullout drawer 26 and a handgun rack 24 with handguns 54 hanging therefrom. In this example, a long rifle may be stored similar to the rifle storage in FIG. 1, in a gun rack formed by the floor 50 and the gun storage bay 18.

Figure 2C:
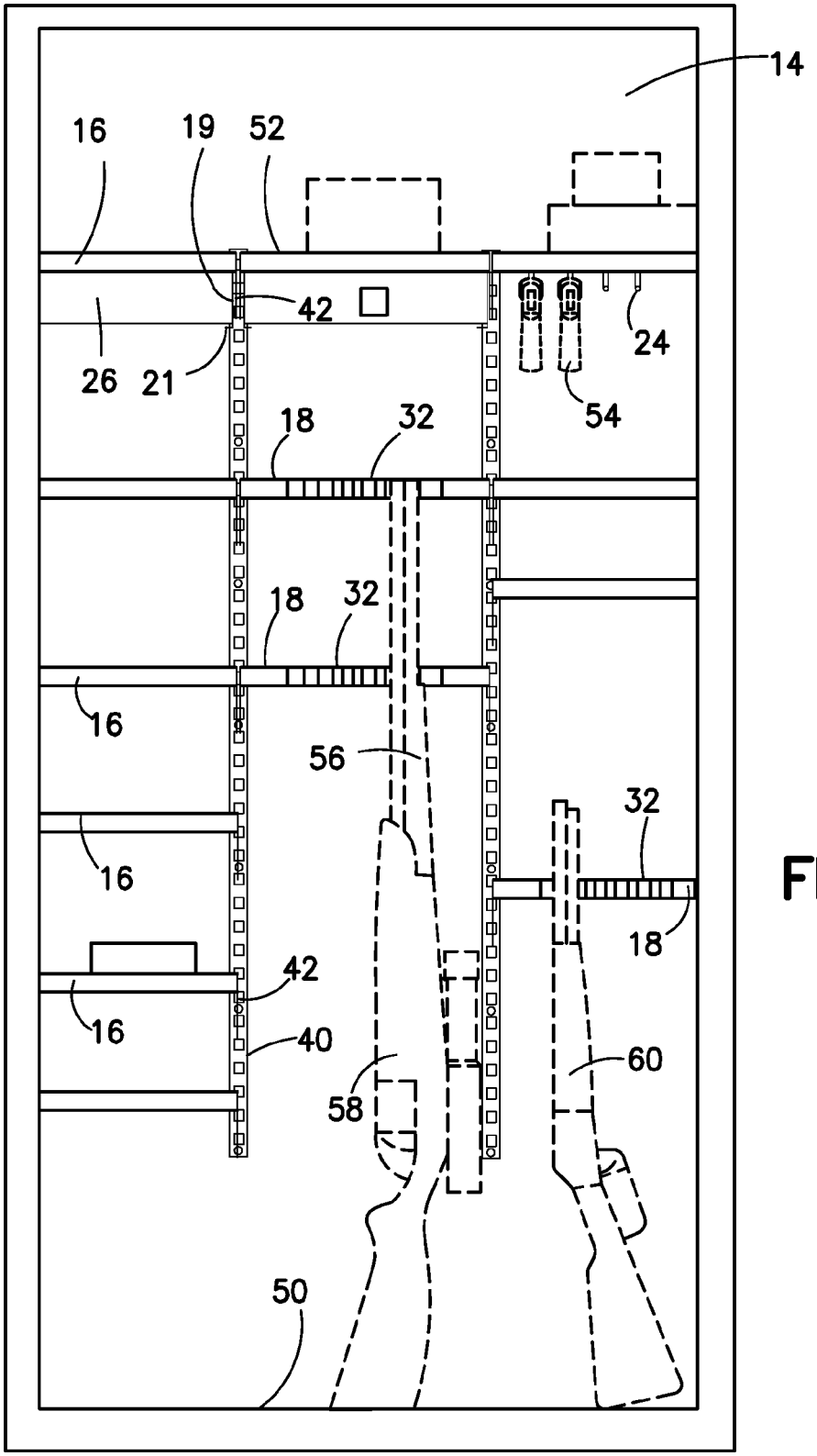
Figure 2D:
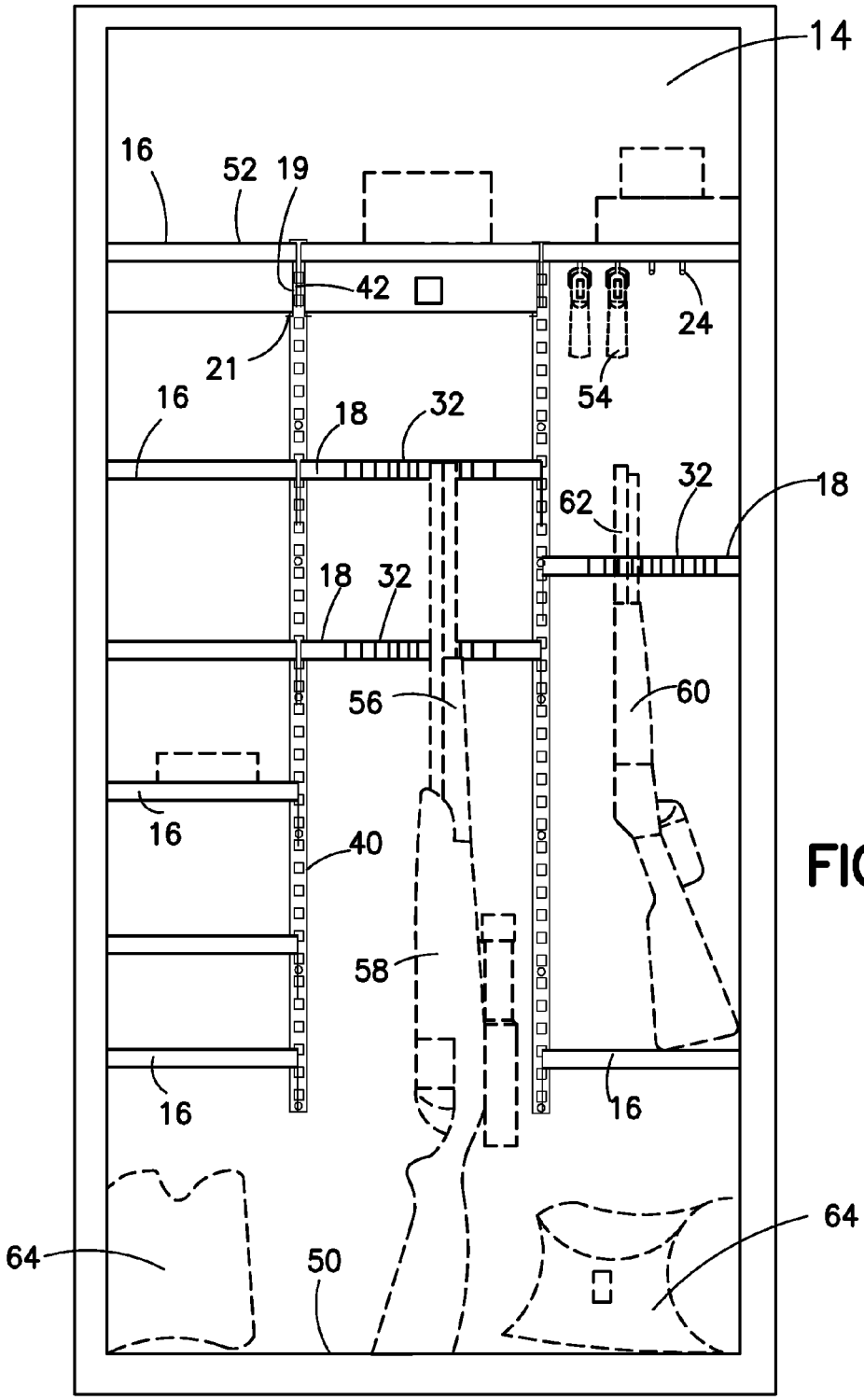

FIGS. 2C and 2D show additional exemplary arrangements of storage elements of the modular storage system 12 including shelves 16, three gun storage bays 18, a pullout drawer 26 and a handgun rack 24 with handguns 54 hanging therefrom. In these examples, two gun storage bays 18 are provided in the center column of storage elements for supporting the barrel 56 of a large rifle 58. The gun rack in the center column is therefore formed by the floor 50 and both gun storage bays 18. However, more than one rack is not necessary for supporting large rifles. A third gun storage bay 18 is provided in the right side column for supporting a smaller size rifle 60. In FIG. 2C, the smaller size rifle is supported by a gun rack formed by the floor 50 and the gun storage bay 18. In FIG. 2D, the gun storage bay 18 in the right side column for the smaller size rifle is positioned above one of the shelves 16 to form an adjustable size and height gun rack. Both the gun storage bay 18 and the shelf 16 are adjustable in height to permit storage of guns of varying lengths (by adjusting the space between the shelf 16 and the gun storage bay 18) and to permit positioning of the gun rack at adjustable heights within the safe (by adjusting the height of both the shelf 16 and the gun storage bay 18). Thus, the smaller size rifle may be stored in the safe in an upright position that is raised off the floor 50 to permit additional items 64 to be stored on the floor 50.

The shelves 16, gun storage bays 18 and other storage elements may be configured in many other combinations and arrangements to provide a vastly versatile, modular storage system for storing guns, valuables and other items 64.

Figure 6:
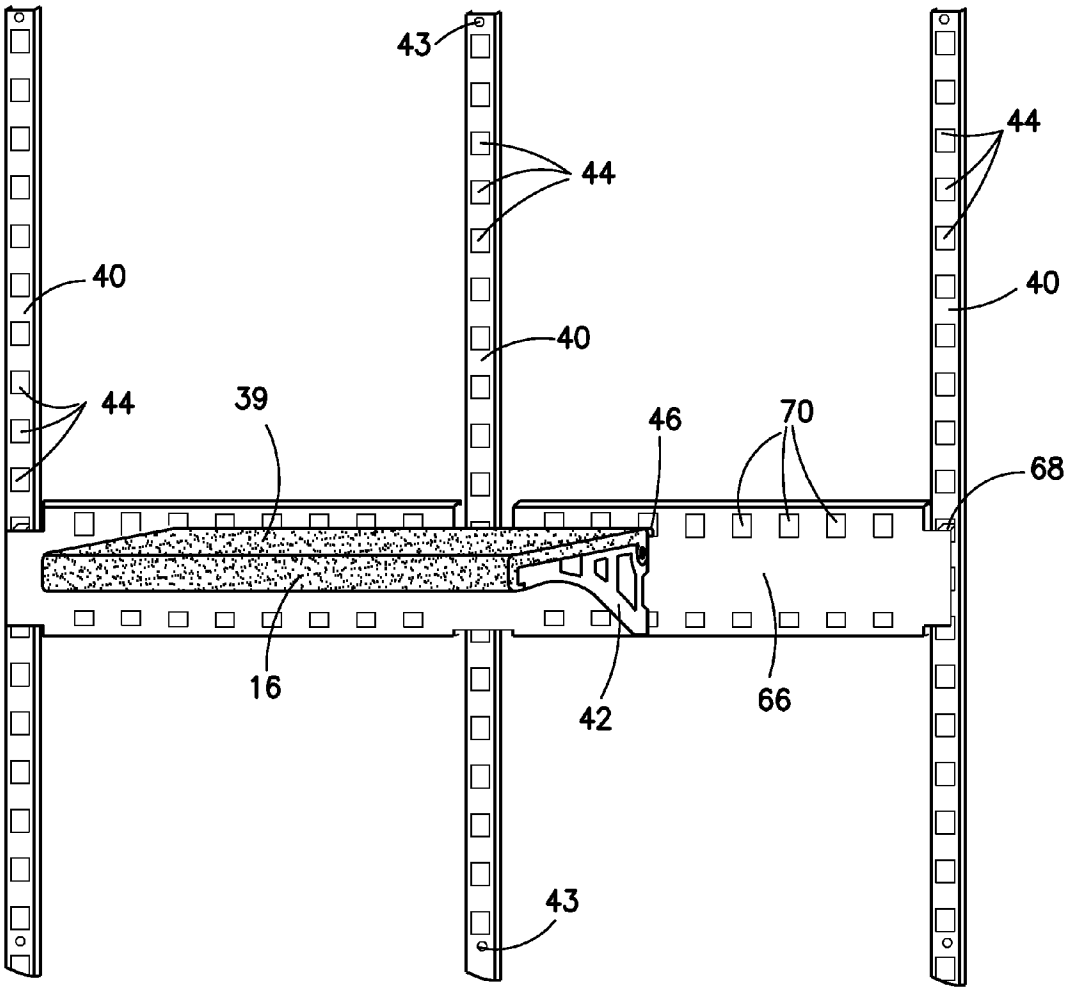
FIG. 6 is a diagram showing a perspective view of an alternative mounting means for use with the modular storage system.

In an alternative embodiment shown in FIG. 6, one or more horizontal bridge supports 66 may be mounted to the vertical tracks 40. For example, the horizontal bridge support 66 may be mounted onto the vertical tracks 40 with a cantilever extension arm 68 that fits into the slots 44 in the track 40. The vertical tracks 40 allows the horizontal bridge support 66 to be positioned at any height, in any increment, along the back wall 15 of the interior compartment 14 of a safe 10. The horizontal bridge support 66 may also or alternatively include slots 70 through which brackets 42 can be removably mounted in a manner similar to the manner the brackets 42 may be removably mounted to the tracks 40.

The horizontal bridge support 66 allows one or more shelves 16 to be mounted at any point across the width of the horizontal bridge support 66, and may be manufactured to be the same width as the standardized shelf width W. The slots 44 in the vertical tracks 40 together with the horizontal bridge support 66 provide adjustability in both the vertical and horizontal directions.

Figure 7:
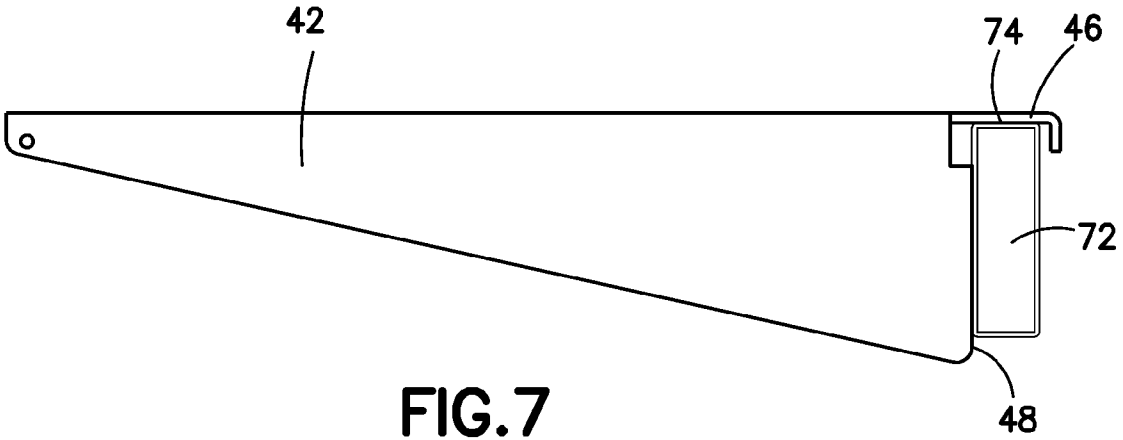
FIG. 7 is a diagram showing a side view of an alternative bracket configuration for use with the modular storage system.

An alternative horizontal bridge support 72 is shown in FIG. 7. This style of bridge support uses an easily removable or loosened nut and bolt, quick release lever or a thumb screw/knob (not shown) on each side of the bridge. The nut may be loosened with a simple nut driver tool. The quick release lever and thumb screw/knob do not require any tools for installation. The bolt can be removed for adjustment of the shelf or can slide in the vertical track 40.

The cantilever shelf brackets 42 are removably mounted on the alternative horizontal bridge support 72 with the bent flange 46 that extends past the back edge 48 of the bracket 42 and fits over the top edge 74 of the alternative horizontal bridge support 72.

In the disclosed system, the horizontal bridge support 66 and alternative horizontal bridge support 72 are optional.

The foregoing modular storage system 12 enables a retailer and/or a consumer to quickly change the shelving configuration from all gun storage, to partial gun/partial shelving storage, or to all shelving storage without the need for a single tool.

The flexibility provided with the disclosed system is unmatched. Shelves 16, gun storage bays 18 and other storage elements may be arranged to occupy any width across the interior compartment 14 of the safe 10 and any height within the safe.

Figure 8:
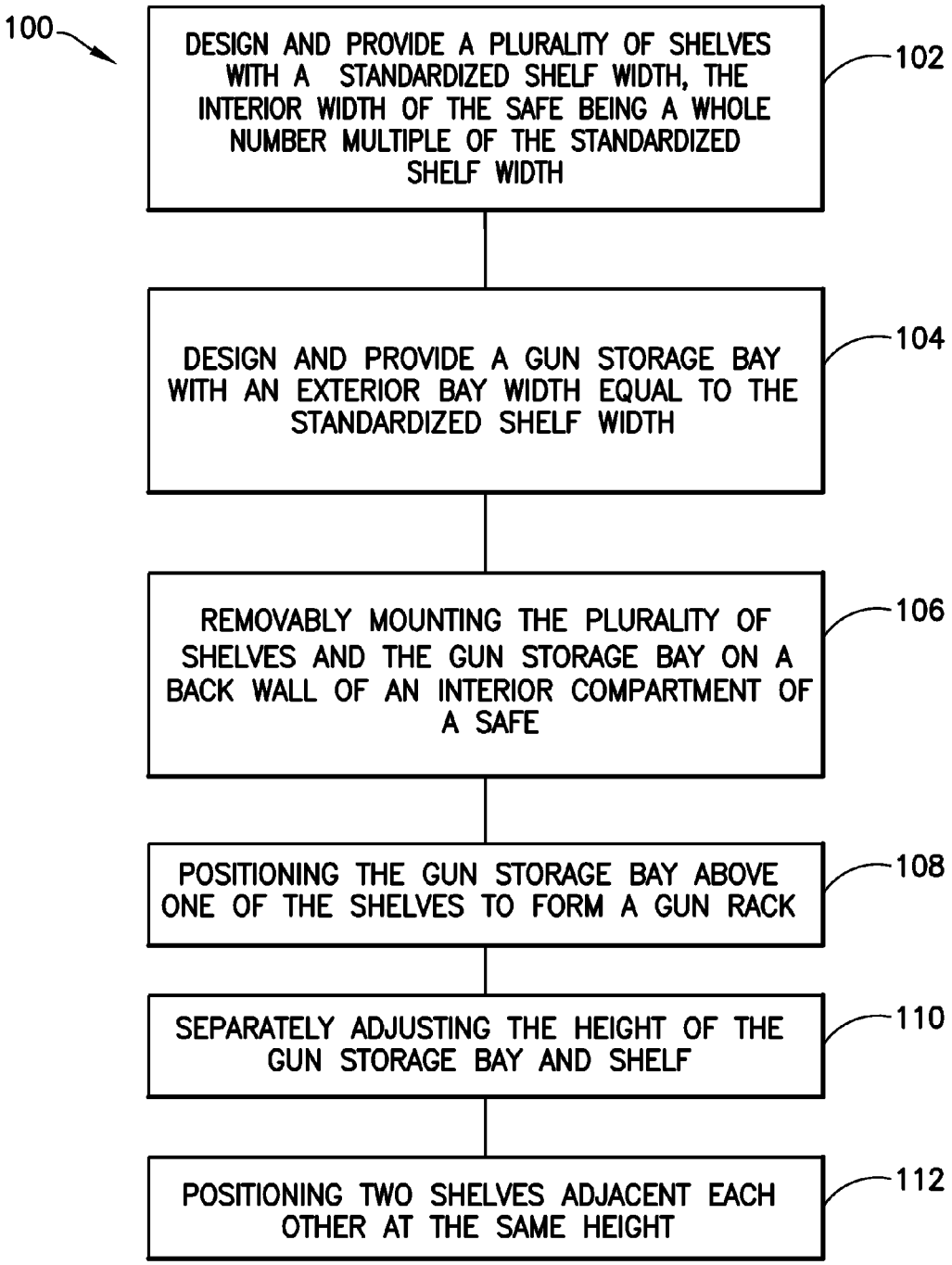
FIG. 8 is a flow diagram showing a method for storing guns in an interior compartment of a safe.

A method 100 for storing guns in an interior compartment 14 of a safe 10 is shown in FIG. 8. The interior compartment 14 has a back wall 15 and two side walls 17 defining an interior width IW of the safe 10. In step 102, a plurality of shelves are designed and provided with a standardized shelf width W. The interior width IW of the safe 10 being designed to be a whole number multiple of the standardized shelf width W. In step 104, a gun storage bay 18 is designed and provided to have an exterior bay width equal to the standardized shelf width W. In step 106, the plurality of shelves 16 and the gun storage bay 18 are removably mounted on the back wall 15 of the interior compartment 14 to permit flexible horizontal and vertical arrangements of the shelves 16 and the gun storage bay 18. In step 108, a gun storage bay 18 is positioned above one of the shelves 16 to form a gun rack, wherein the one of the shelves 16 supports a bottom end of a gun and the gun storage bay 18 supports a top end of the gun. In step 110, the height of the gun storage bay 18 and the height of the one of the shelves 16 are separately adjusted to permit storage of guns of varying lengths and positioning of the gun rack at adjustable heights within the safe. In step 112, two shelves 16 may be positioned adjacent each other at the same height.

Figure 9:
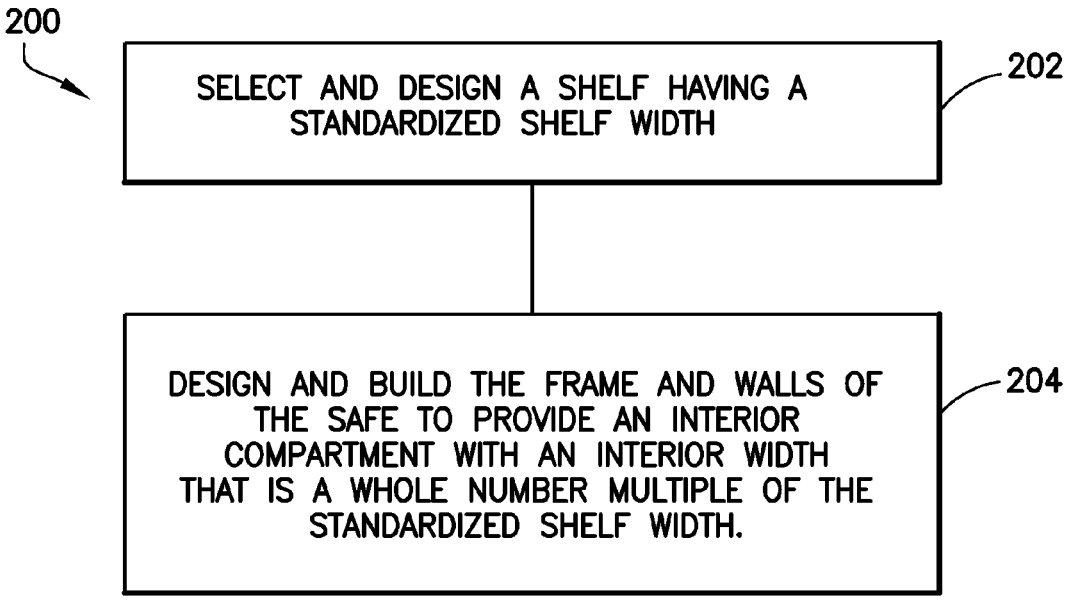
FIG. 9 is a flow diagram showing a method for manufacturing a safe having a modular storage system.

FIG. 9 shows a related method 200 for manufacturing a safe having a modular storage system 12. The method designs the safe 10 from the inside out. First, in step 202, a shelf having a standardized shelf width W is selected and designed, such as a shelf having a standardized shelf width W of 12.5", for example. The safe, and all safes in a manufacturer's line of safes, is then built around the standardized shelf width W. In step 204, the frame and walls of the safe 10 are then designed and built to provide an interior compartment 14 of the safe 10 with an interior width IW that is a whole number multiple of the standardized shelf width W. Thus, all safes would be designed with an interior width IW to fit one or more of shelves 16, gun storage bays 18 or other storage elements having a width equal to the standardized shelf width W. For example, the interior width IW of the narrowest safe may be 12.5" wide to fit one shelf, and the next larger size safe would have an interior width of 25" to fit two shelves across the interior width IW, and the next larger size safe would have an interior width of 37.5" to fit three shelves across the interior width, and so on. The standard size shelf may be any width (not limited to 12.5"), which will become the standard size from which safe interiors will be designed. Preferably, shelves are manufactured in the standard single width (for example, 12.5"), and usable in all safes sold by a manufacturer. One or more standard single width shelves can be installed across the interior compartment of all safes sold by the manufacturer in various configurations, as described for example herein. Alternatively, shelves can be manufactured in double (e.g., 25") or triple (e.g, 37.5") widths provided they are a whole number multiple of the standard size single shelf.

The disclosed system and method provide manufacturing efficiencies, permitting manufacturers to build a large volume of the shelves 16 having a single standardized width W instead of building low volumes of many different size shelves. It also provides convenience for safe dealers and end consumers to easily modify the configuration and arrangement of storage elements in a safe.

While the invention has been described with reference to certain exemplary embodiments, such embodiments are for purposes of illustration and not limitation. It will be understood by those skilled in the art that various modifications may be made and equivalents may be substituted for elements thereof without departing from the scope of the invention. In addition, many modifications may be made to adapt a particular situation to the teachings herein without departing from the scope thereof. For example and without limitation, the precise size of the standard width of the shelf is not critical, provided the safe is designed to have an interior width that is a whole number multiple of the standardized shelf width. Other types of accessories may be developed for use with the modular storage system. The materials used for manufacturing the shelves may be modified to provide additional strength and flexibility features or to reduce weight or expense. All such variations and modifications are intended to be within the scope and spirit of the invention. Therefore it is intended that the claims not be limited to the particular embodiments disclosed. The method claims set forth hereinafter should not be construed to require that the steps recited therein be performed in alphabetical order or in the order in which they are recited, and should not be construed to exclude two or more steps being performed contemporaneously during at least a portion of the duration of one of said steps.

We claim:

1. A modular storage system for an interior compartment of a safe, the interior compartment having a back wall and two side walls defining an interior width of the safe, the system comprising:

a plurality of shelves each having a standardized shelf width adapted to be removably mounted on the back wall, the interior width of the safe being a whole number multiple of the standardized shelf width such that two or more of the shelves are positionable adjacent to each other at the same height in the interior compartment to form a single shelf that extends the interior width of the safe between the two side walls, the shelves having a flat surface extending from a front edge of the shelves to a rear edge of the shelves; and a gun storage bay having an exterior bay width equal to the standardized shelf width and adapted to be removably mounted on the back wall, the gun storage bay being positionable above one of the plurality of shelves to form an adjustable in size and height rack for storing one or more rifles, the flat surface in the one of the plurality of shelves that forms the adjustable in size and height rack providing a surface on which a bottom end of the one or more rifles rest, the gun storage bay and the one of the plurality of shelves both being adjustable in height to permit storage of rifles of varying lengths and to permit positioning of the adjustable in size and height rack at varying heights within the safe such that other items can be stored below the adjustable in size and height rack;

at least three tracks mounted vertically on the back wall of the safe, the tracks each having a plurality of slots spaced along and through a front surface of the tracks, the tracks being spaced apart along the back wall of the safe by a distance substantially equal to the standardized shelf width;

a pair of brackets adapted to be removably secured to the slots in an adjacent pair of the tracks for supporting one of the shelves, each of the slots having a slot width large enough to accept and secure two of the brackets, such that two of the shelves may be positioned adjacent each other at the same height; and storage elements selected from the group consisting of a shelf having drop-in metal or glass inserts, a shelf with a pullout drawer mounted below the shelf, and a shelf with a handgun rack positioned below the shelf, each of the storage elements having a storage element width equal to the standardized shelf width.

2. The modular storage system of claim 1, wherein the shelves comprise a protective surface coating.

3. The modular storage system of claim 2, wherein the shelves comprise a plurality of counter-sunk holes and the protective surface coating extends through the counter-sunk holes and flares out to create an anchor.

4. The modular storage system of claim 1, wherein the shelves and the brackets are formed as a single part.

5. The modular storage system of claim 1, wherein the brackets and the shelves are formed as separate parts and the shelves are positioned on top of the brackets for support.

6. The modular storage system of claim 1, further comprising a horizontal bridge support adapted to be removably secured to the slots in an adjacent pair of the tracks, the horizontal bridge support comprising a plurality of slots in a face of the horizontal bridge support through which the brackets may be removably mounted, the slots in the face of the horizontal bridge support extending across a width of the horizontal bridge support, the width of the horizontal bridge being equal to the standardized shelf width.

7. A modular storage system for an interior compartment of a safe, the interior compartment having a back wall and two side walls defining an interior width of the safe, the system consisting of:

a plurality of shelves each having a standardized shelf width adapted to be removably mounted on the back wall, the interior width of the safe being a whole number multiple of the standardized shelf width such that two or more of the shelves are positionable adjacent to each other at the same height in the interior compartment to form a single shelf that extends the interior width of the safe between the two side walls, the shelves having a flat surface extending from a front edge of the shelves to a rear edge of the shelves;

at least one gun storage bay having an exterior bay width equal to the standardized shelf width adapted to be removably mounted on the back wall and positionable above one of the plurality of shelves to form an adjustable in size and height rack for storing one or more rifles, the flat surface in the one of the plurality of shelves that forms the adjustable in size and height rack providing a surface on which a bottom end of the one or more rifles rest, the gun storage bay and the one of the plurality of shelves both being adjustable in height to permit storage of rifles of varying lengths and to permit positioning of the adjustable in size and height rack at varying heights within the safe such that other items can be stored below the adjustable in size and height rack;

at least three tracks mounted vertically on the back wall of the safe, the tracks each having a plurality of slots spaced along and through a front surface of the tracks, the tracks being spaced apart along the back wall of the safe by a distance substantially equal to the standardized shelf width;

at least one pair of brackets adapted to be removably secured to the slots in an adjacent pair of the tracks for supporting one of the shelves, each of the slots having a slot width large enough to accept and secure two of the brackets, such that two of the shelves may be positioned adjacent each other at the same height;

storage elements selected from the group consisting of a shelf having drop-in metal or glass inserts, a shelf with a pullout drawer mounted below the shelf, and a shelf with a handgun rack positioned below the shelf, each of the storage elements having a storage element width equal to the standardized shelf width; and a horizontal bridge support adapted to be removably secured to the slots in an adjacent pair of the tracks, the horizontal bridge support comprising a plurality of slots in a face of the horizontal bridge support through which the brackets may be removably mounted, the slots in the face of the horizontal bridge support extending across a width of the horizontal bridge support, the width of the horizontal bridge being equal to the standardized shelf width.

* * * * *